US005632260A

United States Patent [19]

Kato

[11] Patent Number: 5,632,260

[45] Date of Patent: May 27, 1997

[54] CONTROL SYSTEM AND METHOD FOR ENGINE

[75] Inventor: Masahiko Kato, Hamamatsu, Japan

[73] Assignee: Sanshin Kogyo Kabushiki Kaisha, Hamamatsu, Japan

[21] Appl. No.: 610,641

[22] Filed: Mar. 4, 1996

[30] Foreign Application Priority Data

Mar. 3, 1995 [JP] Japan ..... 7-044190

[51] Int. Cl.[6] ..... F02D 41/00

[52] U.S. Cl. ..... 123/673

[58] Field of Search ..... 123/673, 676, 123/489, 440, 486; 364/431.05, 431.03, 431.04

[56] References Cited

U.S. PATENT DOCUMENTS 4,962,741 10/1990 Cook et al. ..... 123/489
5,020,502 6/1991 Wild ..... 123/673
5,131,371 7/1992 Wahl et al. ..... 123/436
5,158,058 10/1992 Yoshida et al. ..... 123/434
5,419,301 5/1995 Schechter ..... 123/673
5,548,514 8/1996 Hasegawa et al. ..... 364/431.05

*Primary Examiner*—Raymond A. Nelli
*Attorney, Agent, or Firm*—Knobbe, Martens, Olson & Bear LLP

[57] ABSTRACT

An engine air-fuel ratio control system for a multi-cylinder engine that employs a fuel-air ratio sensor which is associated with only one cylinder. The other cylinders are operated leaner than that with which the sensor is associated. Also, the system can operate on an open control, and when switching from open control to feedback control, the incremental adjustments in fuel amount are initially made smaller and for a longer time period so as to reduce overshooting and hunting while permitting quick recovery during subsequent feedback control operation.

26 Claims, 8 Drawing Sheets $$\text{Average (Adjustment Amount for Cylinder w/o sensor)} = \frac{\frac{q1 + q2}{2} + \frac{q3 + q4}{2}}{2}$$

CONTROL SYSTEM AND METHOD FOR ENGINE

BACKGROUND OF THE INVENTION

This invention relates to a control system and method for an engine, and more particularly to a fuel control for an engine that operates with a feedback control principle during at least a portion of its operation.

In the interest of providing good fuel economy and effective exhaust emission control, it has been proposed to employ a feedback control system for controlling the air-fuel ratio of the engine. The feedback control acts primarily on the fuel supply to maintain the desired air-fuel ratio, although other systems are possible.

When operating with feedback control systems, it is the practice to use a sensor that provides a signal indicative of the actual air-fuel ratio supplied to the engine. Oxygen ($O_2$) sensors are commonly utilized for this purpose. The oxygen sensor senses the amount of oxygen in the exhaust gases, and from this it can determine whether the actual mixture supplied to the combustion chamber is lean or rich, or at the desired ratio.

In order to provide an accurate indication of the actual combustion chamber conditions, it is desirable if the sensor is positioned as close as possible to the exhaust discharge of the engine. That is, the sensor should be as close as possible to the point where the exhaust gases exit the combustion chamber.

With multiple cylinder engines, therefore, it is difficult to utilize only a single sensor for all cylinders of the engine. If the sensor is positioned downstream of the exhaust ports of the cylinders far enough to receive an average signal, it will be too far from the cylinders to be accurate and helpful. Therefore, many systems provide an arrangement wherein only one sensor is utilized to control the fuel supply amount for all of the cylinders.

Where this is done, however, it is the normal practice to assume that each cylinder is operating on substantially the same fuel-air ratio as the other. That is, when an adjustment is made for the sensed cylinder, the same adjustment is made for the remaining cylinders. With many engines and engine configurations, however, this assumption is not only not accurate, but can be at substantial variance from the actual engine conditions.

For example, in outboard motor practice, the exhaust system is relatively compact and, as a result, the difference in the distance from each exhaust port to the end of the exhaust discharge is substantially different. This provides varying in-cylinder conditions which effect the optimum air-fuel ratio for each cylinder.

It is, therefore, a principal object of this invention to provide an improved feedback control system for a multiple cylinder engine that employs only a single sensor for all cylinders.

It is a further object of this invention to provide a feedback control system of this type wherein the sensor is positioned so that the condition in all cylinders can be adjusted accurately based upon this one sensing position.

In connection with the use of such an arrangement utilizing only a single cylinder, it may be desirable to provide fixed differences in the amount of feedback control adjustment applied to each cylinder. However, the variation in adjustment also is not uniform under all conditions.

It is, therefore, a still further object of this invention to provide an improved feedback control system for a multicylinder engine utilizing only a single sensor and wherein the adjustments to the nonsensed cylinders are made depending upon running conditions.

In many systems that employ feedback control, there are times when the feedback control is not utilized, but an open control is utilized. For example, the type of sensor previously referred to (an $O_2$ sensor) must be at a certain operating temperature before it will give a reading. As a result, it has been proposed to employ an open control for the system during initial start-up and until the oxygen sensor reaches its operating temperature. Thus, when the shift-over from open control to feedback control occurs, there will be, more than likely, some adjustment that needs to be made.

In addition, during feedback control operation, adjustments also are required in order to bring the air-fuel ratio to the desired condition. Generally, these adjustments are made in incremental steps, and the incremental adjustment is the same, regardless of whether being made during the switch-over condition or during transient conditions of feedback control.

Another condition when there may be a shifting between feedback control and open control is if the sensor is deemed to be somehow inoperative or providing unreliable signals after it has reached its operating temperature. It has been proposed to provide an arrangement for detecting such conditions and switching over to open control when this occurs. Again, however, the adjustment during such shift-over positions is made on the same basis as during transient conditions, and this also may not be desirable.

It is, therefore, a still further object of this invention to provide an improved control system and method for an engine that is operable on both open and feedback controls and wherein the incremental adjustments are varied depending upon the condition which exists. This reduces the likelihood of hunting and permits more rapid return to the desired air-fuel ratio independently of the cause for the deviation.

SUMMARY OF THE INVENTION

A first feature of this invention is adapted to be embodied in an air-fuel ratio control system and method for a multi-cylinder internal combustion engine. An air-fuel charging system is provided for delivering an air-fuel charge to each cylinder of the engine. An exhaust system is also provided for discharging the combustion products from the cylinders of the engine to the atmosphere. A sensor is provided for sensing the air-fuel ratio in only one of the cylinders. A feedback control system controls the air-fuel ratio in response to the output of the sensor for maintaining the desired air-fuel ratio.

In accordance with a system for practicing the invention, the amount of change made for the cylinder associated with the sensor is greater than that for the remaining sensors when adjustment is necessary.

In accordance with a method for practicing the invention, the cylinder associated with the sensor is adjusted to a larger amount than the remaining sensors in response to a deviation from the desired ratio as sensed by the sensor.

Another feature of the invention is adapted to be embodied in a method and apparatus for controlling the air-fuel ratio of an internal combustion engine. The engine has a combustion chamber and an air and fuel charging system for delivering a fuel-air charge to the combustion chamber. A sensor is provided for sensing the air-fuel ratio in the combustion chamber. In addition, at least one engine running condition is also sensed. The system is operative to provide both an open control wherein the air-fuel ratio is controlled only by the output of the engine condition sensor or a feedback control wherein the air-fuel ratio is controlled by the output of the air-fuel ratio sensor.

In accordance with an apparatus for practicing the invention, the incremental fuel adjustments made during open control are less than those made during feedback control.

In accordance with a method for practicing the invention, the incremental adjustments in the fuel-air ratio made during the changeover from open control to feedback control are smaller than those made to cover transient conditions during feedback control.

DETAILED DESCRIPTION OF THE PREFERRED EMBODIMENTS OF THE INVENTION

Figure 1:
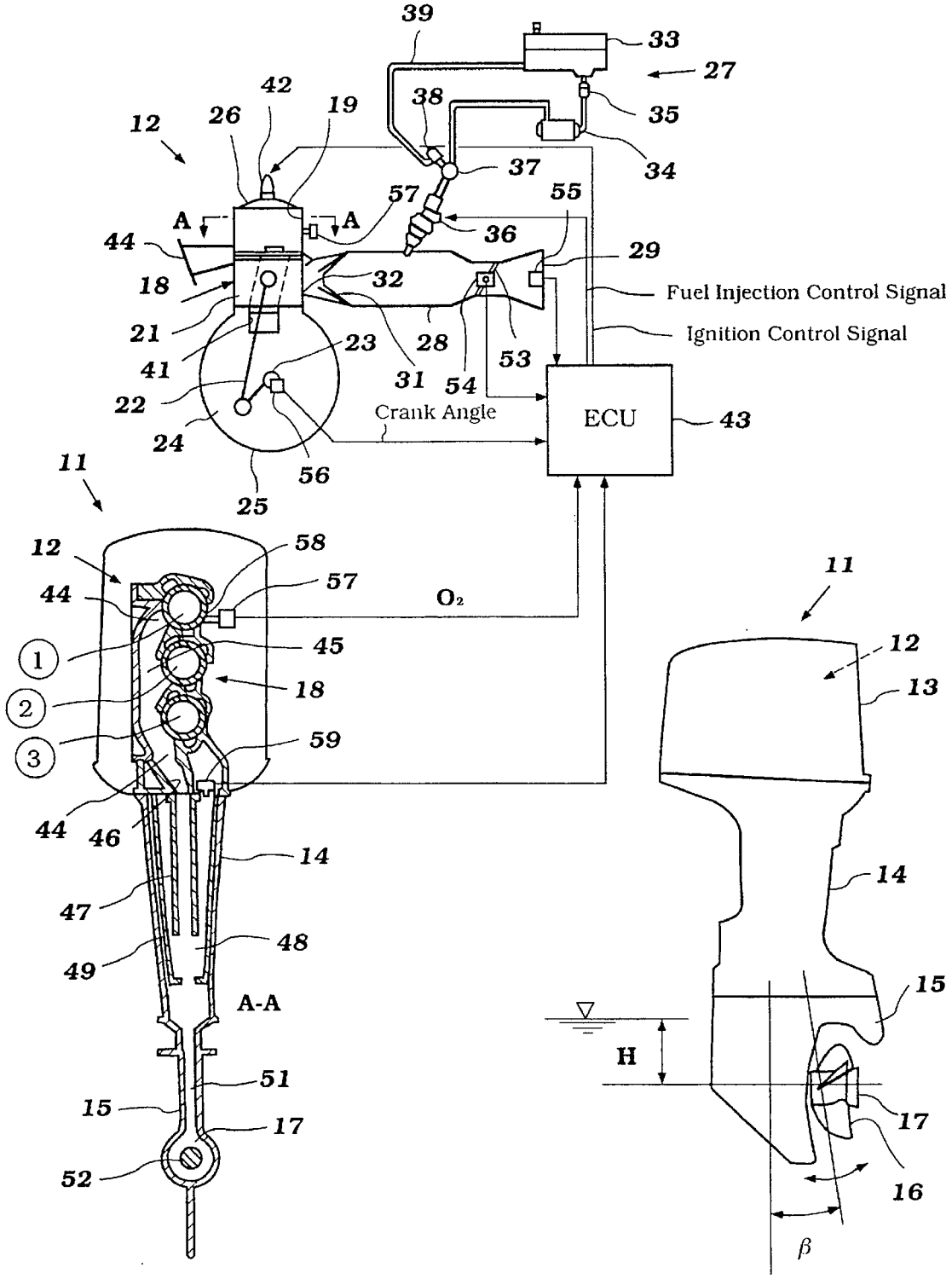
FIG. 1 is a composite view of three figures showing, (1) in the lower right-hand side, a side elevational view of an outboard motor constructed in accordance with an embodiment of the invention; (2) in the lower left-hand side, a cross-sectional view of the outboard motor taken along the line A—A of the upper view and looking generally at the rear of the outboard motor; and (3) in the upper view a partially schematic cross-sectional view taken through a single cylinder of the engine.

Referring now in detail to the drawings and initially to FIG. 1, an outboard motor constructed and operated in accordance with an embodiment of the invention is identified generally by the reference numeral 11. The outboard motor 11 is chosen as an illustrative embodiment of a construction wherein the invention has particular utility. This is in part because outboard motors normally, as with other marine propulsion units, discharge their exhaust gases beneath the level of water in which the watercraft is operating. Since this effective depth of discharge can vary, as will become described, the back pressure on the engine varies and hence the optimum fuel/air ratio also varies. Furthermore outboard motors have compact exhaust systems where the back pressure and exhaust pulse back conditions at each cylinder may vary significantly from the others.

The outboard motor 11 is shown in side elevational view in the lower right-hand view and includes a power head that is comprised of a powering internal combustion engine, indicated generally by the reference numeral 12 and which is surrounded by a protective cowling 14.

As will become apparent, the engine 12 is mounted so that its output or crankshaft rotates about a vertically extending axis. This is common practice in outboard motors so as to facilitate coupling of the engine output shaft to a drive shaft (not shown) which is journaled about a vertically extending axis within a drive shaft housing 14 disposed at the lower end of the power head. By having the engine output shaft also rotate about a vertically extending axis, the use of transmissions or other mechanisms for converting horizontal rotation to vertical rotation are eliminated.

The drive shaft which depends through the drive shaft housing 14 terminates in a lower unit 15 where a known type of transmission (not shown) drives a propeller 16 in selected forward and reverse directions.

Not shown in this figure but as is typical with outboard motor practice, the outboard motor 11 is mounted for steering movement about a generally vertically extending steering axis and for tilt and trim movement about a generally horizontally extending trim axis. This tilt and trim movement permits trim adjustment of the propeller 12 and its angle of attack through a range as indicated by the angle $\beta$ in FIG. 1.

As is typical in outboard motor and other marine propulsion practice, the exhaust gases from the engine 12 are discharged, in a manner which will be described, through an underwater exhaust discharge, most typically formed in the hub 17 of the propeller. As a result of the trim adjustment through the angle $\beta$, the depth of the exhaust gas discharge below the water level as indicated by the dimension H will vary with the trim angle. In addition, the direction of the exhaust gas discharge also will vary from downwardly facing to upwardly facing. Because of this, the back pressure on the engine can vary significantly as the trim angle is adjusted.

Referring now primarily to the left-hand lower and upper views in this figure, the engine 12 is depicted as being of the three cylinder in-line type. Although the invention is described in conjunction with such an arrangement, it will be readily apparent to those skilled in the art how the invention can be practiced with engines having other cylinder numbers and other cylinder configurations. Also, the engine 12 operates on a two-cycle crankcase compression principle. Again, however, it will be readily apparent to those skilled in the art how the invention can be employed with engines operating on four-stroke principles.

Since the actual internal details of the engine 12 form no significant portion of the invention, the engine 12 has been depicted generally in schematic form and will be described only generally. Those skilled in the art can readily refer to any known prior art type of constructions for examples of engines with which the engine may be practiced.

The engine 12 includes a cylinder block 18 in which three horizontally disposed cylinder bores are formed. The cylinder bores are indicated by the reference numeral 19 and are vertically spaced from each other so as to provide the in-line construction as aforenoted. The cylinders are numbered 1, 2, and 3 beginning at the uppermost end as shown by the reference characters in the lower left-hand view of FIG. 1.

Pistons 21 reciprocate in each of the cylinder bores 19 and are connected by means of connecting rods 22 to a crankshaft 23. The crankshaft 23 rotates, as aforenoted, about a vertically extending axis within a crankcase chamber 24 formed by a crankcase member 25 that is affixed to the cylinder block 18 and by the skirt of the cylinder block 18. As is typical with two-cycle crankcase compression engines, the crankcase chambers 22 associated with each of the cylinder bores 19 are sealed from each other in any suitable manner.

A cylinder head 26 is affixed to the cylinder block 18 on the side opposite the crankcase member 25. The cylinder head 26 has individual recesses which cooperate with the cylinder bores 19 and pistons 21 to form the individual combustion chambers of the engine.

A fuel and air charge forming system, indicated generally by the reference numeral 27, is provided for delivering a fuel/air charge to these combustion chambers. This system includes an air intake manifold 28 which is shown schematically and which has an atmospheric air opening 29 that receives atmospheric air from within the protective cowling 13. As is well known in this art, the protective cowling 13 is provided with a suitable atmospheric air inlet to permit air to enter its interior for engine operation.

The intake manifold 28 has a plurality of individual runners, one for each crankcase chamber 24 in which reed-type check valves 31 are provided. The reed-type check valves 31 permit air and fuel, as will become apparent, to enter the crankcase chambers 24 through adjacent intake ports 32 when the pistons 21 are moving upwardly in the cylinder bores 19 and the volume of the crankcase chamber 24 is increasing. However, as the pistons 18 move downwardly, the check valves 31 will close and permit the charge to be compressed in the crankcase chambers 24.

In addition to the air as thus far described, fuel is also mixed by the system 27 with the air charge inducted into the crankcase chambers 24. The illustrated embodiment depicts a manifold-type injection system for this purpose. It will be readily apparent to those skilled in the art, however, that this invention may be employed in conjunction with engines having other types of fuel supply systems including direct cylinder injection.

The fuel supply system includes a remotely positioned fuel tank 33 from which fuel is drawn by means of a pump 34 through a filter 35. This fuel is then delivered to individual fuel injectors 36 each of which sprays into a respective one of the runners of the intake manifold 28. A fuel rail 37 connects the fuel supply system to the injectors 36 in a well known manner.

A pressure control valve 38 is provided in the fuel rail 37 and regulates the pressure of the fuel supplied to the injectors 36 by dumping excess fuel back to the fuel tank 33 or some other position in the fuel supply system through a return conduit 39.

Thus, because of the manifold injection system described, a fuel/air mixture is introduced into the crankcase chambers 24 and is compressed, as aforenoted. The compressed charge is then transferred to the combustion chambers through one or more scavenge passages 41. This charge is then further compressed in the combustion chamber and is fired by means of spark plugs 42.

The spark plugs 42 are fired by an ignition system under the control of an ECU, indicated generally by the reference numeral 43. The ECU 43 also controls the timing and duration of fuel injection from the injectors 36. It should be noted that the injectors 36 illustrated are of the electrically operated, solenoid type although other types of injectors may also be employed.

As the spark plugs 42 fire, the fuel/air charge in the combustion chambers will burn and expand to drive the pistons 21 downwardly and drive the crankshaft 23 as is well known in this art.

The exhaust gases from combustion are discharged through an exhaust system to the aforenoted underwater exhaust discharge in a manner which will now be described. Each cylinder bore 19 is provided with a respective exhaust port 44 which exhaust ports 44 communicate with an exhaust manifold 45 that is formed in part integrally within the cylinder block 18, as is also typical with outboard motor practice. This exhaust manifold 45 terminates in a downwardly facing discharge opening 46 which communicates with the upper end of an exhaust pipe 47. The exhaust pipe 47 discharges into an expansion chamber 48 formed by an inner shell 49 of the drive shaft housing 14 for silencing purposes. The exhaust gases then flow downwardly through an exhaust passage 51 formed in the lower unit 15 for discharge through the hub discharge port 17 around a propeller shaft 52 which drives the propeller 16, as aforenoted.

The compact nature of the exhaust system has the aforenoted effects of causing the pressure conditions at the exhaust ports of the cylinders 1, 2 and 3 to vary significantly.

As has been noted, the ECU 43 operates so as to control not only the timing of the firing of the spark plugs 42 but also the timing and duration of fuel injection from the fuel injectors 36. For this purpose, the ECU receives certain signals from engine operating and ambient conditions. Only certain of those signals will be described because it is believed within the scope of those skilled in the art to understand that various types of control strategies may be employed. The invention deals primarily with the feedback control system.

In order to control the speed of the engine 12 there is provided a throttle valve 53 which is interposed in the air inlet 29 of the induction and charge forming system 27 for controlling the air flow to the engine. A throttle position sensor 54 is associated with the throttle valve 53 and outputs a throttle valve position signal to the ECU 43. This signal is in essence a load demand signal on the engine. In addition, an air flow sensor 55 is mounted in the atmospheric air inlet opening 29 so as to provide a signal representative of the amount of intake air to the ECU 53.

A crank angle sensor 56 is associated with the crankshaft 23 and outputs a crank angle signal to the ECU 43. This crank angle signal permits the ECU 43 to determine the angular position of the crankshaft for timing of the firing of the spark plugs 42 and for injection of fuel from the injectors 36. Also by counting the number of pulses generated by the sensor 56 in a given time period, the engine speed may also be calculated.

The system further includes, as has been noted, a feedback control system and therefore a combustion condition sensor indicated by the reference numeral 57 is provided. In the illustrated embodiment, the combustion condition sensor 57 constitutes an oxygen ($O_2$) sensor which communicates with the exhaust port of one of the cylinders (cylinder#l) through a sensing port 58. The oxygen sensor outputs a signal indicative of the density of the oxygen in the exhaust gases. As is well known, this signal can be utilized to determine the actual fuel/air ratio in the engine. More specifically, it may be utilized to determine if the fuel/air ratio is stoichiometric, i.e., $\lambda=1$.

As has been noted, the desired fuel/air ratio also will depend upon exhaust back pressure and this is measured by a back pressure sensor 58 that communicates with the expansion chamber 48 to provide a back pressure signal to the ECU 43. Other factors which effect back pressure such as trim angle, etc., may also be supplied. As has been previously noted, still further ambient and engine running conditions may be utilized in the overall fuel/air ratio control for the engine.

From the foregoing description, it should be readily apparent that the oxygen sensor 57 is associated only with the uppermost number 1 cylinder. However, because of the arrangement which will now be described, it is possible to achieve very effective feedback control for all cylinders from the output from this one sensor 57.

Figure 2:
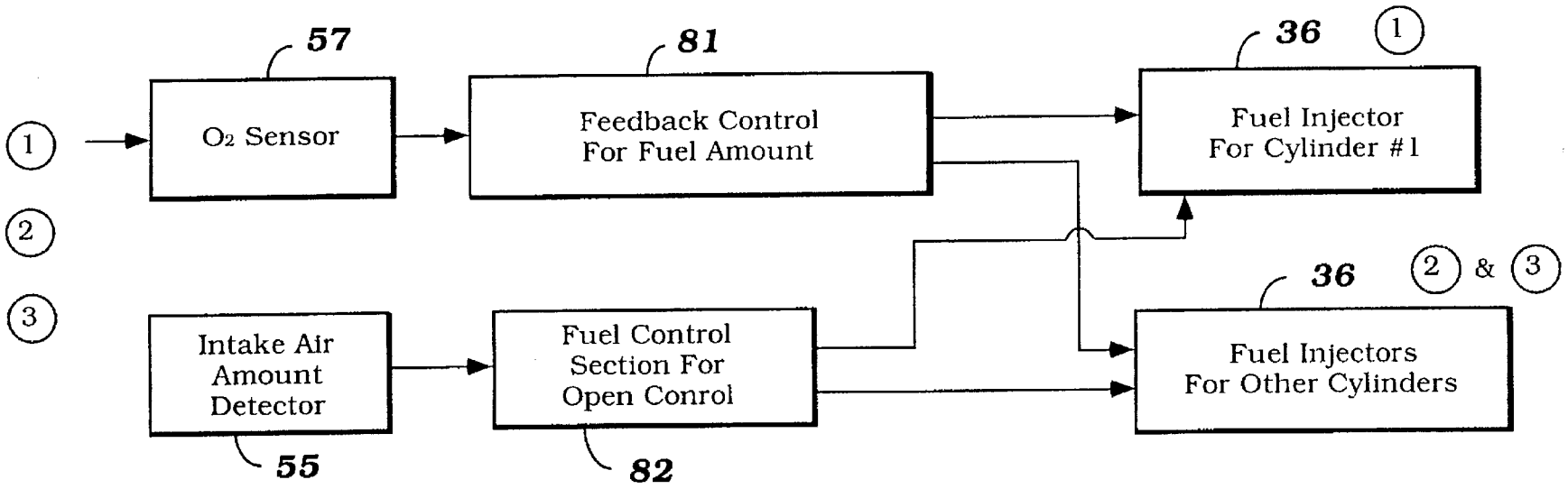
FIG. 2 is a schematic block diagram showing the relationship of the components for controlling the fuel injection amount to maintain the desired fuel-air ratio.

FIG. 2 shows the relationship of the various elements of the control system, including the oxygen sensor 57. In this embodiment, the cylinder with which the oxygen sensor 57 is associated is the number 1 cylinder, or the one furthest from the discharge end of the exhaust pipe 47. It is to be understood, however, that with other engines or with other control strategies, the oxygen sensor 57 may be associated with a different cylinder.

The oxygen sensor 57 outputs its signal to a feedback control section 81 of the ECU 43 for controlling the fuel injection 36 associated with the cylinder with which the oxygen sensor 57 is connected. The feedback control 81 also outputs a signal to the fuel injectors 36 of the remaining two cylinders. But this amount of fuel injection differs from the signal which is sent to cylinder number 1 or that associated with the oxygen sensor 57. Normally, this control will be leaner than that for the cylinder with which the sensor is associated. This relationship will be described later by reference to FIGS. 3 and 4. It is assumed that the stoichiometric fuel-air ratio is selected for the cylinder associated with the oxygen sensor.

The intake air volume detector 55 outputs its signal to a fuel control section 82 of the ECU 43, which operates to control the fuel injector 36 of the sensed cylinder, and the fuel injectors 36 of the nonsensed cylinders in response to engine running parameters. In the illustrated embodiment, intake air amount is employed, but other controls may be utilized, such as engine speed and/or engine load, as determined by various factors, such as the degree of opening of the throttle valve.

Under open control, the amount of fuel injected by the injector associated with the sensed cylinder is larger than that of the nonsensed cylinders. This is the basic philosophy, and this control will now be described by particular reference to FIGS. 3 and 4, which show the conditions under feedback and open controls, respectively.

Figure 3:
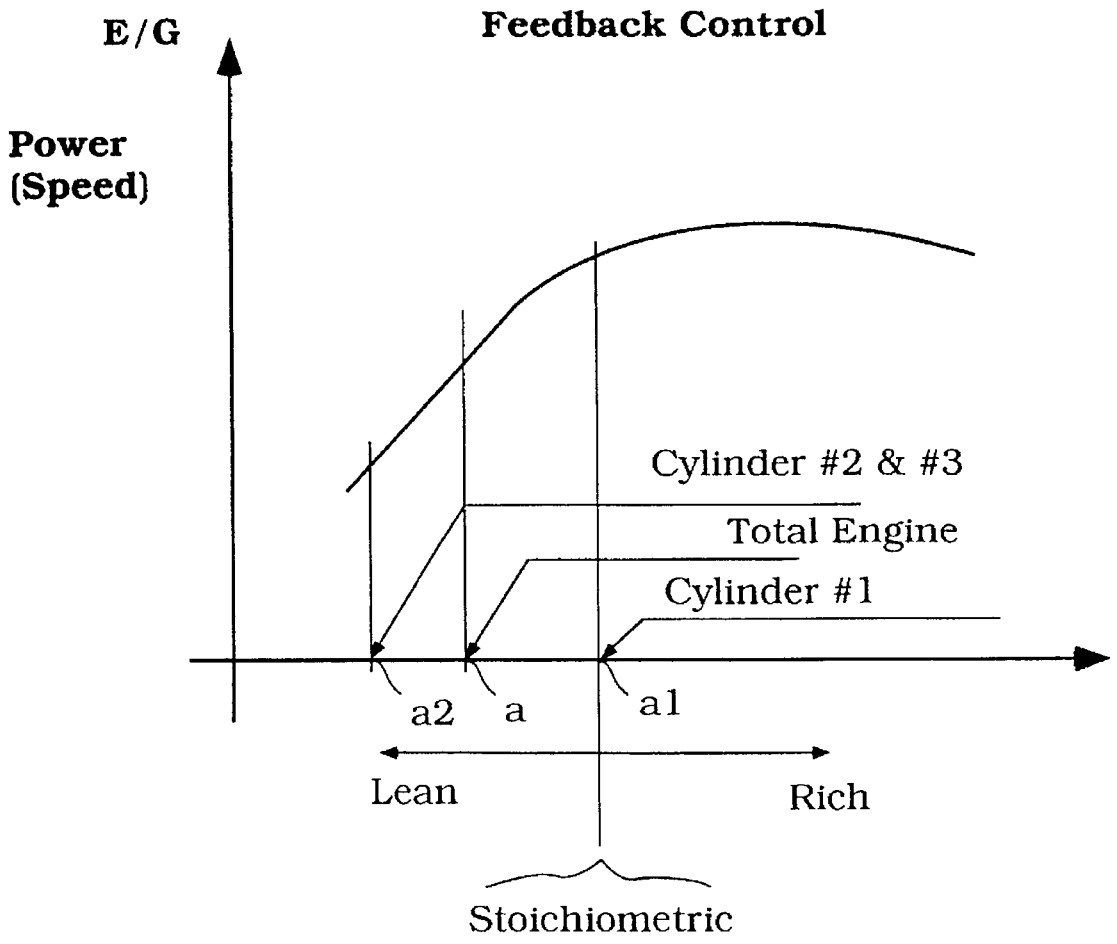
FIG. 3 is a graphical view showing the setting for the fuel-air ratio of the various cylinders during feedback control, and indicates the respective engine power and/or speed during these control conditions.
Figure 4:
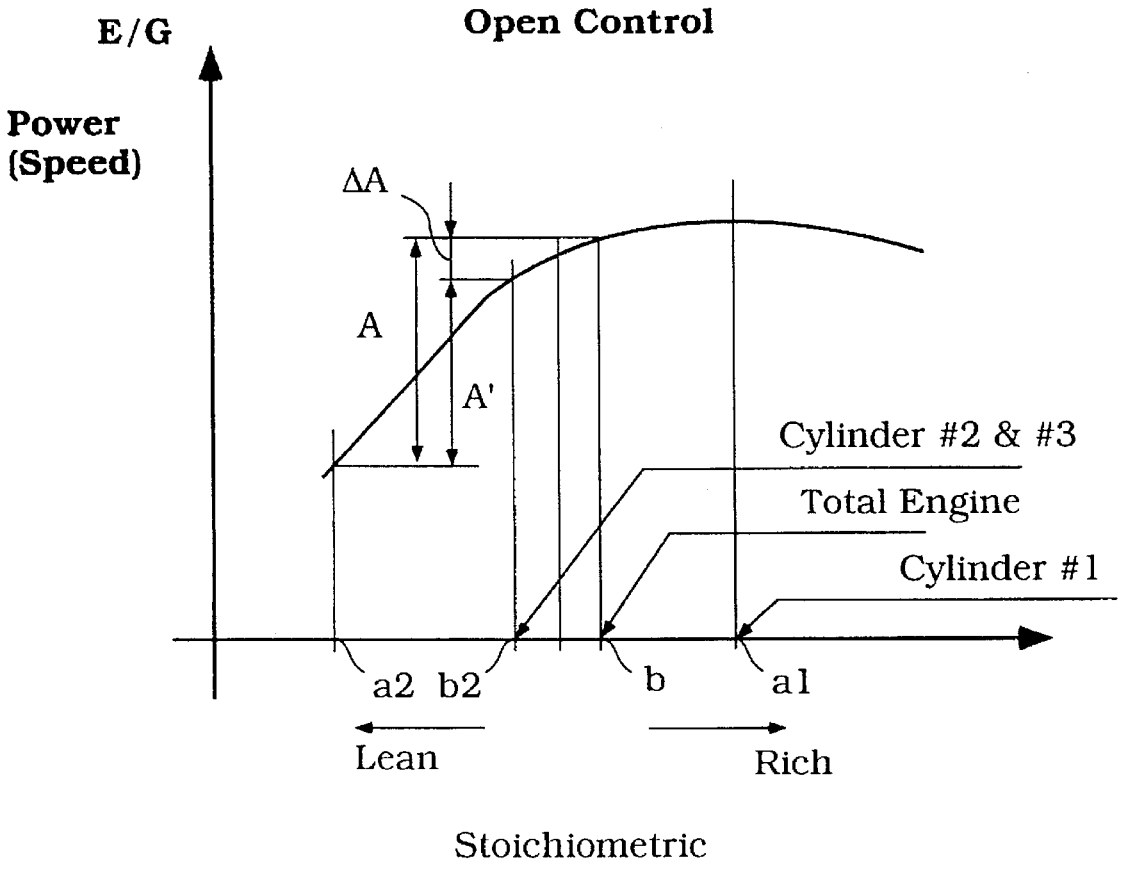
FIG. 4 is a graphical view, in part similar to FIG. 3, and shows the same conditions during open control.

As seen in both FIGS. 3 and 4, when the mixture is set at stoichiometric, the engine power, or engine speed, if the power is maintained constant, will be less than that possible when operating on the rich side, as is well known. However, the stoichiometric point is still at a point near the maximum power and/or speed, with the power and speed falling off more rapidly as the mixture becomes leaner. In accordance with the control strategy, the air-fuel ratio for the cylinder associated with the oxygen sensor 57, cylinder number 1 in this instance, is set at stoichiometric. This is indicated at the point al. The settings for the remaining cylinders are made on the lean side of stoichiometric at a point indicated at a2 by utilizing a lesser amount or duration of fuel injection for those cylinders. As a result, the total air-fuel ratio for the engine is at the point a, which is on the lean side of stoichiometric.

The same relationship generally holds true for control under the open control (FIG. 4). However, under open control, and when the feedback control will not be enjoyed, the fuel-air ratio al for cylinder number 1 is set on the rich side of stoichiometric. This point is also richer than the point al from the feedback control mode.

In addition, the mixture supplied to the remaining cylinders (numbers 2 and 3 in this example) is richer than the mixture a2 and closer to stoichiometric at the point b2. The total air-fuel ratio for the engine under open control is set slightly richer than stoichiometric at the point b. Hence, the power reduction between the total engine a and those of the two cylinders 2 and 3 not associated with the oxygen sensor A', is ΔA below the fuel-air ratio supplied to the total engine.

Figure 5:
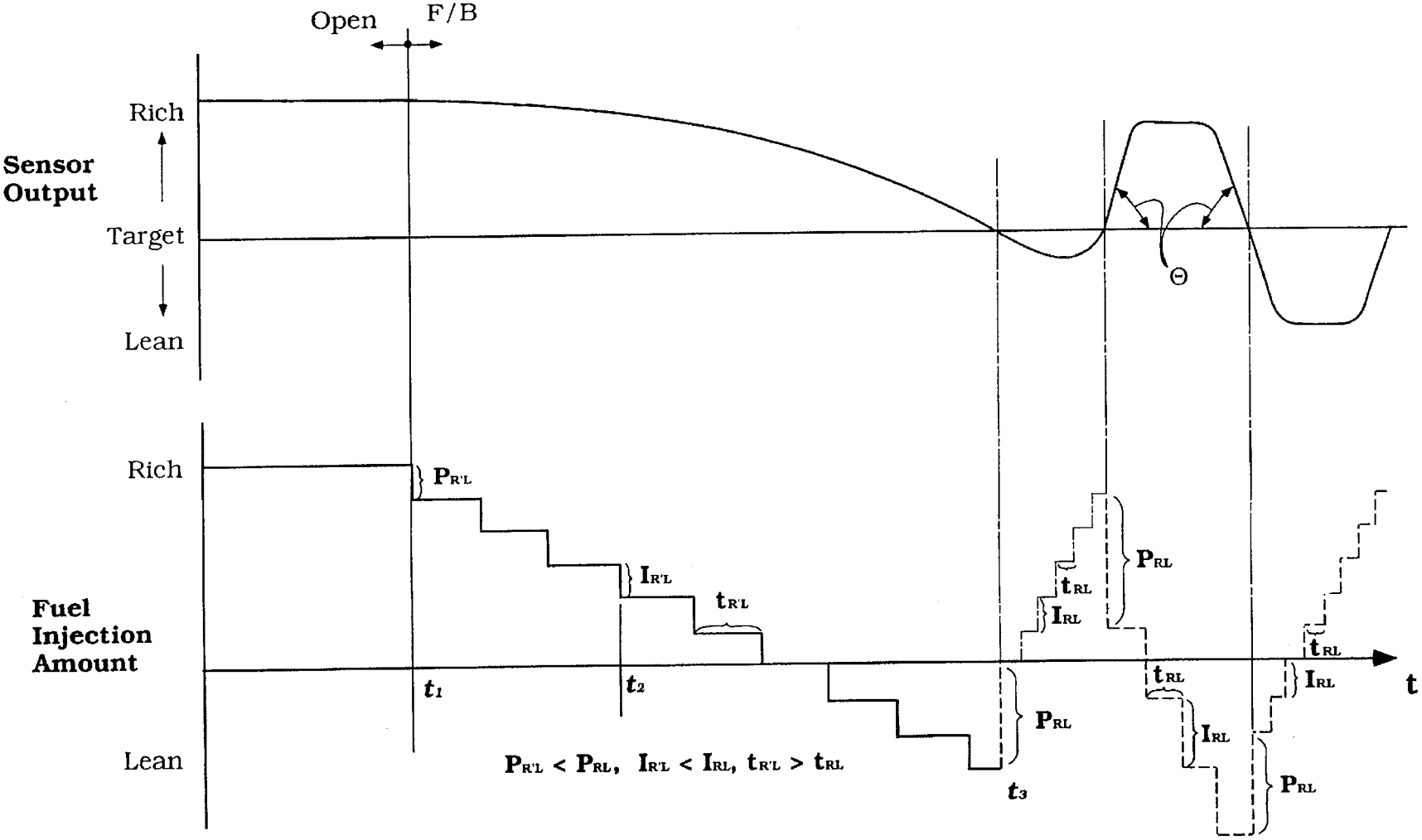
FIG. 5 is a graphical view showing the sensor output and fuel injection amounts during a control phase, and when there is a transition being made from open control to feedback control.

Another facet of the control strategy and methodology is shown in FIG. 5. As will be seen from the description of this figure, this methodology deals with the incremental step-by-step adjustments made during the feedback control range, depending upon whether the adjustment is made immediately upon the transition from open to feedback control or is made to accommodate transient conditions under feedback control. Under normal control systems and methods, the step-by-step adjustment is maintained at the same level and same time intervals.

This invention, however, employs a methodology wherein the magnitude of the adjustment and the time of the adjustment is varied in response to the type of transient condition being encountered. This is done for a reason which will be described and which has been found to provide less hunting in the engine running conditions, and better response. The transition from open control to feedback control may occur at the end of the original engine start-up/warm-up phase, and after the oxygen sensor 57 reaches its operating temperature. This point in time is indicated on the timeline of FIG. 5 as $t_1$.

As may be seen and as should be apparent, the engine is set so as to run slightly richer than stoichiometric under open control. This is done primarily for engine protection, but also may be done so as to provide quicker warm-up during start-up operation.

As a result, the sensor 57, when it does become operative and outputs a signal, will indicate a rich condition. Hence, the amount of fuel supplied to the fuel injectors 36 is reduced in steps. As previously noted, under conventional methodology, the steps are generally of fixed amount and during fixed time intervals, and the same as that made during transient conditions that exist during the feedback control running.

In accordance with the invention, however, an adjustment in fuel injection amount equal to $P_{R'L}$ is made, and this adjustment is made in equal amounts during time interval $t_{R'L}$. In the illustrated embodiment, there are three large adjustments being made, and assuming that the oxygen sensor 57 still continues to send out a rich signal. After a time period $t_2$, if the mixture is still rich, then the amount of incremental fuel adjustment amount of decrease is made at the smaller amount $I_{R'L}$ again for the time period $t_{R'L}$. Thus, these steps continue until the sensor indicates the target or stoichiometric range at the time $t_3$.

Once this condition has been met, then the system resorts to a control strategy whereby incremental adjustments in fuel injection amount to maintain stoichiometric or the target ratio are made larger during smaller intervals. Again, the adjustments are made in initial and subsequent steps. The initial step appearing after the time $t_3$ makes an adjustment in the amount $P_{RL}$, with $P_{RL}$ being substantially greater than $P_{R'L}$. The time interval between adjustments is also made smaller for the time intervals $t_{RL}$, as opposed to the time adjustments during transition $t_{R'L}$.

After the initial single large adjustment, smaller step adjustments $I_{RL}$ are made until the sensor output again crosses the target range. The adjustment amounts $I_{RL}$ are also greater than those during the transition phase $I_{R'L}$. As a result, the slope of change of output of the sensor 57, indicated at θ in FIG. 5, will be substantially greater during transient conditions. This provides quicker response. However, if these large adjustments were made during the changeover from open control to feedback control, substantial hunting would result. Therefore, this system provides quick recovery, without hunting, under all conditions.

Figure 6:
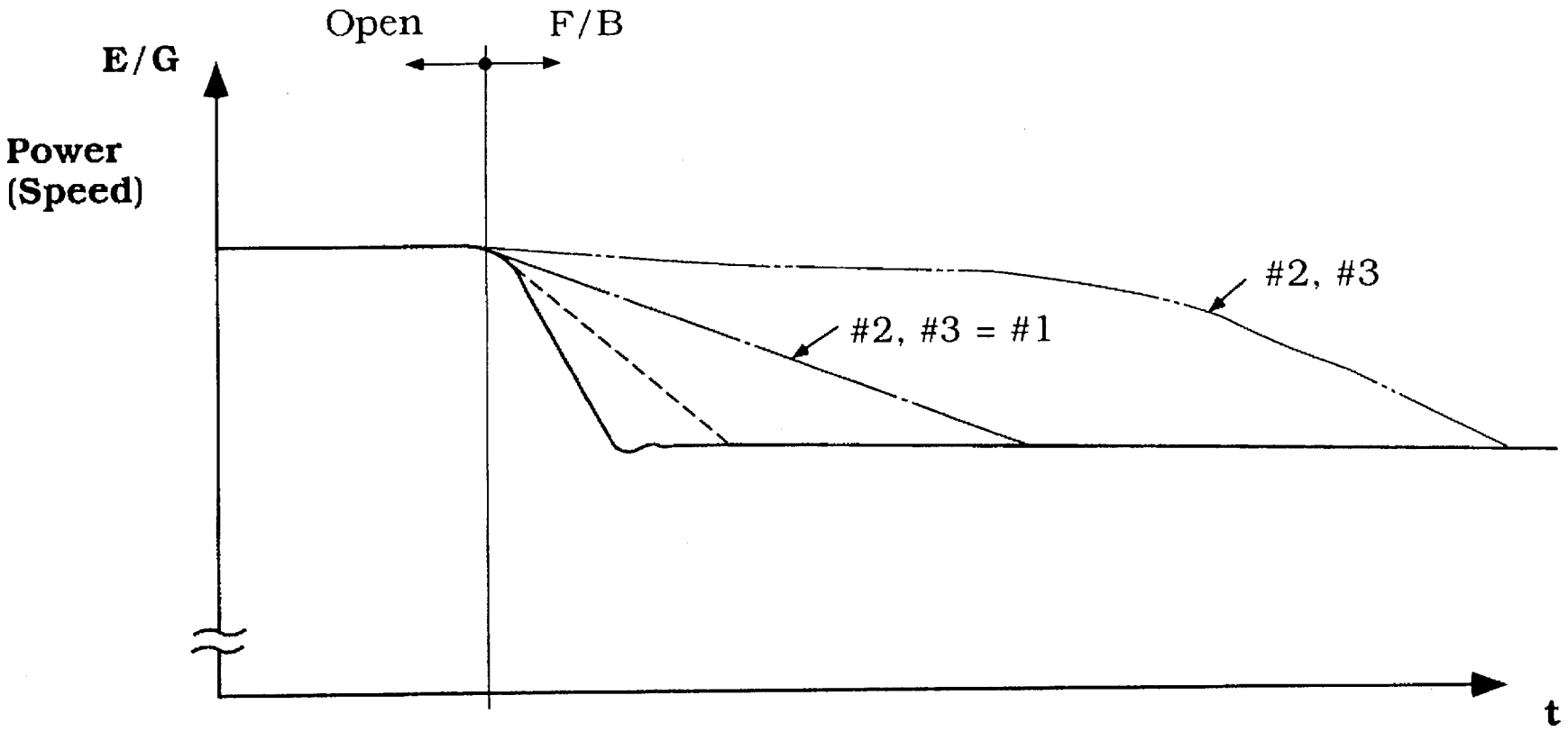
FIG. 6 is a graphical view showing the condition of engine power and fuel injection amounts during the transition from open control to feedback control, and after a time period has elapsed between this control shift.

Another feature of the invention deals with the amount of fuel adjustment correction made between the cylinder in which the oxygen sensor 57 is associated and the remaining cylinders, both during the initial shifting of operation from open to feedback control and subsequent respective adjustments. As this feature can be understood best by reference to FIG. 6, which shows the fuel adjustment amount during the phase immediately after the transition to feedback control, and also the fuel adjustment made after a time period has elapsed or until the mixture has reached the target time period for the first time. As may be seen in this figure, during initial feedback control, the amount of fuel supplied to each cylinder is decreased in equal amounts until the target range is reached. After that, the amount of reduction in fuel supply is greater for cylinders numbers 2 and 3 (those not associated with the sensor) when deviations result. This again provides quicker response and less hunting.

Figure 7:
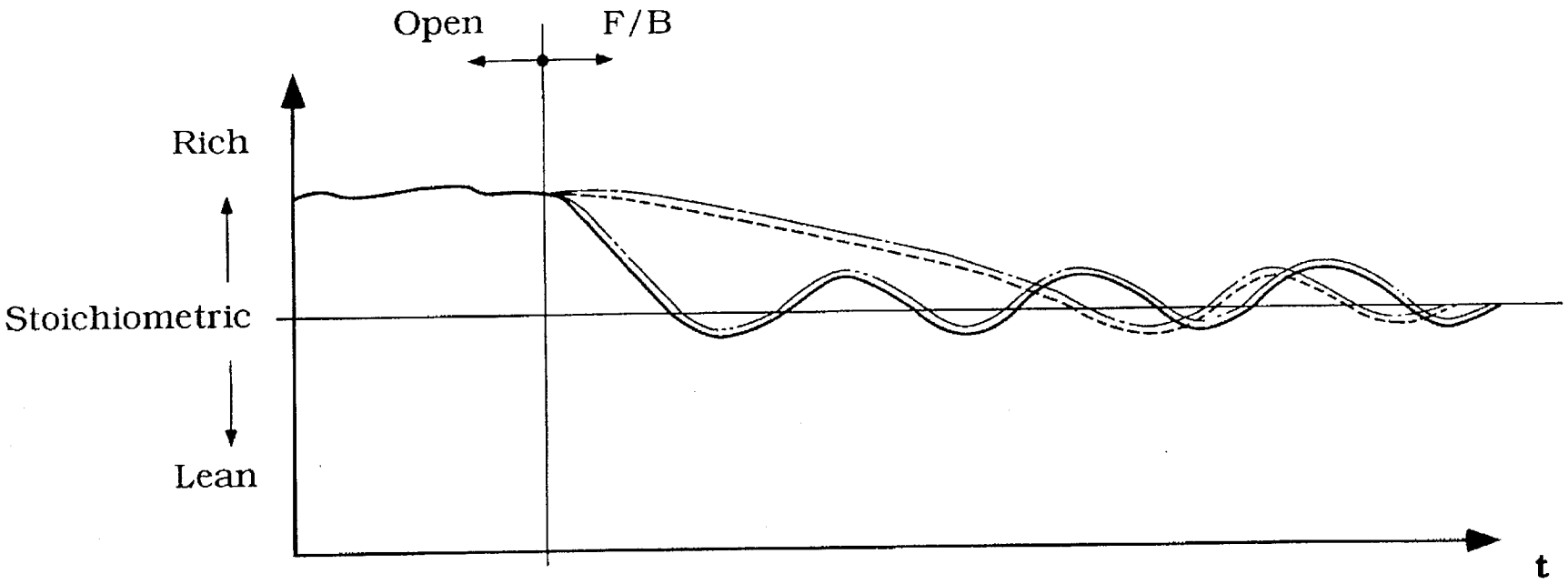
FIG. 7 is a graphical view showing the sensor output and improved performance possible in conjunction with this system.

The effect of this may be seen also in FIG. 7. It will be seen that if the method employing the invention is not used, as seen by the solid line, there is a large degree of hunting before stabilization occurs. However when this method is employed, the resumption to stoichiometric is more gradual and results in less hunting. This is shown by the broken and phantom line views of this figure.

Figure 8:
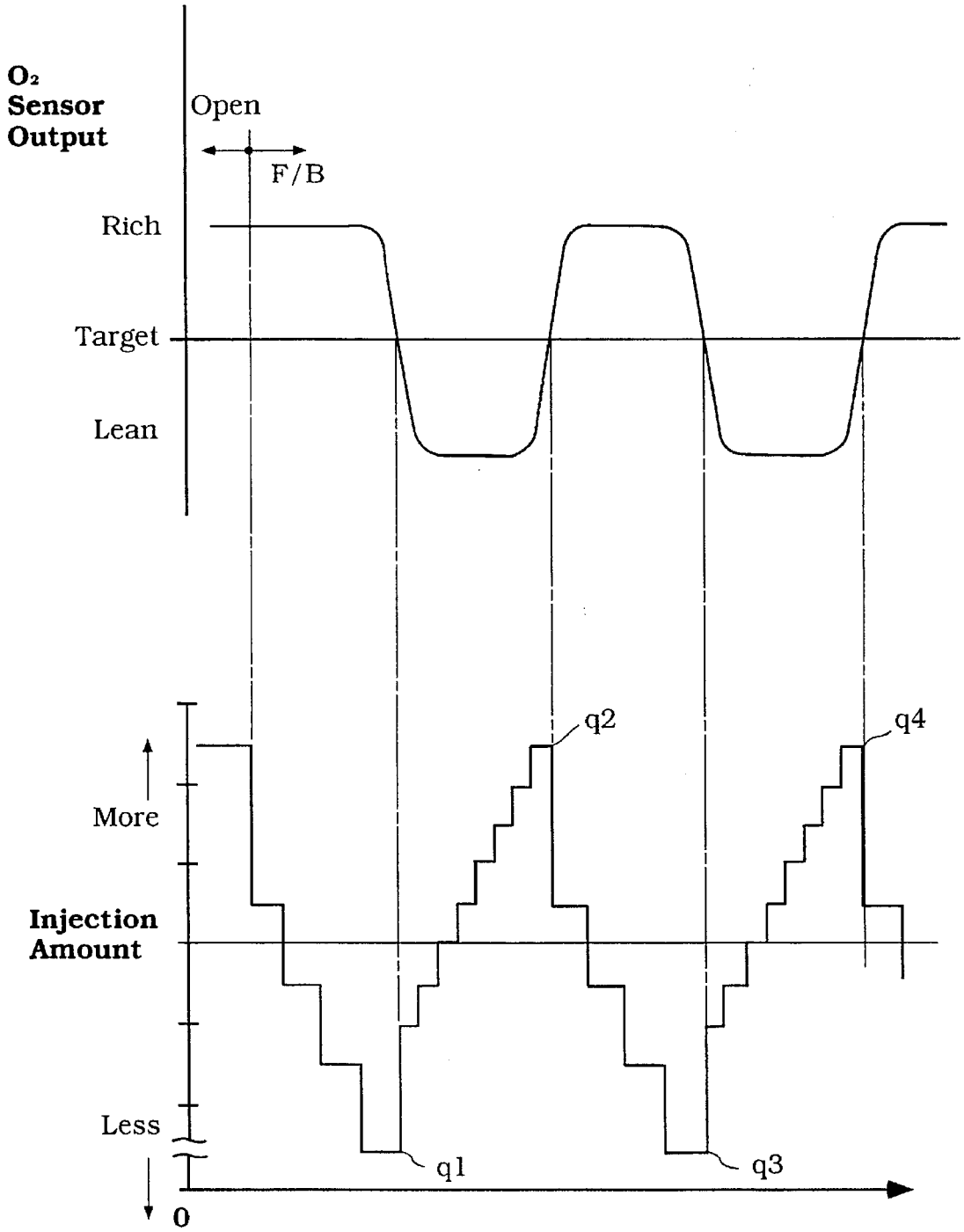
FIG. 8 is a graphical view showing how the sensor output and fuel injection amount is related during a control period and for the cylinder which are not associated with the sensor.

FIG. 8 shows the strategy and computation whereby the amount of adjustment for those cylinders not associated with the sensor is determined. As may be seen, during a cycle of operation upon feedback control, the actual injection amount for the cylinder associated with the sensor during two cycles of operation varies from minimums q1 and q3 to maximums of q2 and q4. Thus, in order to determine the optimum adjustment amount for the other cylinders, a mathematical calculation is made in accordance to determine the adjustment for other cylinders as being equal to the following:

$$[(q1+q2)\div 2+(q3+q4)\div 2]\div 2$$

Thus, from the foregoing, it should be readily apparent that it is possible to control all cylinders of a multicylinder engine through the sensing of the conditions of fuel-air ratio in only one cylinder. This system also does not require the same fuel-air ratios for all cylinders, and is designed in such a way so as to improve response time during transient running, but to avoid hunting when shifting over from open to feedback control. Of course, those skilled in the art will readily understand that the foregoing description is that of preferred embodiments of the invention, and that various changes and modifications may be made without departing from the spirit and scope of the invention, as defined by the appended claims.

What is claimed is:

1. A fuel-air control system for an internal combustion engine having at least two combustion chambers, a fuel-air introducing system for supplying a fuel-air mixture to each of said combustion chambers, an exhaust system for collecting exhaust gases from said cylinders and discharging them to the atmosphere, an air-fuel ratio sensor associated with only one of said combustion chambers for sensing the air-fuel ratio in that combustion chamber, and feedback control means for adjusting the air-fuel ratio in each of said combustion chambers by adjusting the fuel-air induction system associated therewith, said feedback control system controlling the combustion chamber with which the sensor is associated to provide the target air-fuel ratio and to provide a leaner than target air-fuel ratio for the combustion chamber with which the sensor is not associated.

2. A fuel air-fuel combustion system as in claim 1, wherein the target air-fuel ratio for the combustion chamber with which the sensor is associated is the stoichiometric ratio.

3. A fuel air-fuel combustion system as in claim 1, wherein there are more than two combustion chambers, and all combustion chambers other than that associated with the air-fuel ratio sensor are supplied with the same leaner mixture.

4. A fuel air-fuel combustion system as in claim 3, wherein the target air-fuel ratio for the combustion chamber with which the sensor is associated is the stoichiometric ratio.

5. A fuel air-fuel combustion system as in claim 1, further including means for sensing an engine running condition, and open control means for providing a range of engine control other than feedback control depending upon the sensed engine condition.

6. A fuel air-fuel combustion system as in claim 5, wherein the air-fuel ratio supplied to the combustion chamber not associated with the sensor is also leaner than that associated with the sensor during open control.

7. A fuel air-fuel combustion system as in claim 6, wherein the target air-fuel ratio for the combustion chamber with which the sensor is associated is the stoichiometric ratio.

8. A fuel air-fuel combustion system as in claim 5, wherein the fuel-air ratio is maintained richer during open control than during feedback control.

9. A fuel air-fuel combustion system as in claim 8, wherein the amount of incremental adjustments in fuel-air ratio is made lesser during the initial time period when switching from open control to feedback control than after the target range has been reached the first time in the feedback control mode.

10. A fuel air-fuel combustion system as in claim 9, wherein the time interval between subsequent adjustments during the initial resumption of feedback control is longer than during subsequent corrections.

11. A fuel air-fuel combustion system as in claim 8, wherein the time interval between subsequent adjustments during the initial resumption of feedback control is longer than during subsequent corrections.

12. A fuel air-fuel combustion system as in claim 8, wherein the adjustment of the fuel-air ratio is the same for all combustion chambers during the initial resumption of feedback control.

13. A fuel-air control system for an internal combustion engine having at least two combustion chambers, a fuel-air introducing system for supplying a fuel-air mixture to each of said combustion chambers, an exhaust system for collecting exhaust gases from said cylinders and discharging them to the atmosphere, an air-fuel ratio sensor associated with only one of said combustion chambers for sensing the air-fuel ratio in that combustion chamber, feedback control means for adjusting the air-fuel ratio in each of said combustion chambers by adjusting the fuel-air induction system associated therewith, at least one engine running condition sensor, an open control system for adjusting the air-fuel ratio in each of said cylinders in response to the output of said engine running condition sensor, and means for selectively changing the mode of engine control between feed back and open control,the amount of incremental adjustment in fuel-air ratio is made lesser during the initial time period when switching from open control to feedback control than after the target range has been reached the first time in the feedback control mode.

14. A fuel-air control method for an internal combustion engine having at least two combustion chambers, a fuel-air introducing system for supplying a fuel-air mixture to each of said combustion chambers, an exhaust system for collecting exhaust gases from said cylinders and discharging them to the atmosphere, an air-fuel ratio sensor associated with only one of said combustion chambers for sensing the air-fuel ratio in that combustion chamber, and feedback control means for adjusting the air-fuel ratio in each of said combustion chambers by adjusting the fuel-air induction system associated therewith, said method comprising the steps of controlling the combustion chamber with which the sensor is associated to provide the target air-fuel ratio and providing a leaner than target air-fuel ratio for the combustion chamber with which the sensor is not associated.

15. A fuel air-fuel combustion method as in claim 14, wherein the target air-fuel ratio for the combustion chamber with which the sensor is associated is the stoichiometric ratio.

16. A fuel air-fuel combustion method as in claim 14, wherein there are more than two combustion chambers, and all combustion chambers other than that associated with the air-fuel ratio sensor are supplied with the same leaner mixture.

17. A fuel air-fuel combustion method as in claim 16, wherein the target air-fuel ratio for the combustion chamber with which the sensor is associated is the stoichiometric ratio.

18. A fuel air-fuel combustion method as in claim 14, further including the steps of sensing an engine running condition, and providing an open control range of engine control other than feedback control depending upon the sensed engine condition.

19. A fuel air-fuel combustion method as in claim 18, wherein the air-fuel ratio supplied to the combustion chamber not associated with the sensor is also leaner than that associated with the sensor during open control.

20. A fuel air-fuel combustion method as in claim 19, wherein the target air-fuel ratio for the combustion chamber with which the sensor is associated is the stoichiometric ratio.

21. A fuel air-fuel combustion method as in claim 19, wherein the fuel-air ratio is maintained richer during open control than during feedback control.

22. A fuel air-fuel combustion method as in claim 21, wherein the amount of incremental adjustments in fuel-air ratio is made lesser during the initial time period when switching from open control to feedback control than after the target range has been reached the first time in the feedback control mode.

23. A fuel air-fuel combustion method as in claim 22, wherein the time interval between subsequent adjustments during the initial resumption of feedback control is longer than during subsequent corrections.

24. A fuel air-fuel combustion system as in claim 13, wherein the time interval between subsequent adjustments during the initial resumption of feedback control is longer than during subsequent corrections.

25. A fuel air-fuel combustion system as in claim 13, wherein the adjustment of the fuel-air ratio is the same for all combustion chambers during the initial resumption of feedback control.

26. A fuel-air control method for an internal combustion engine having at least two combustion chambers, a fuel-air introducing system for supplying a fuel-air mixture to each of said combustion chambers, an exhaust system for collecting exhaust gases from said cylinders and discharging them to the atmosphere, an air-fuel ratio sensor associated with only one of said combustion chambers for sensing the air-fuel ratio in that combustion chamber, feedback control means for adjusting the air-fuel ratio in each of said combustion chambers by adjusting the fuel-air induction system associated therewith, at least one engine running condition sensor, an open control system for adjusting the air-fuel ratio in each of said cylinders in response to the output of said engine running condition sensor, said method comprising the steps of selectively changing the mode of engine control between feed back and open control and making the amount of incremental adjustment in fuel-air ratio lesser during the initial time period when switching from open control to feedback control than after the target range has been reached the first time in the feedback control mode.

* * * * *